US010597836B2

(12) United States Patent
Andreas

(10) Patent No.: US 10,597,836 B2
(45) Date of Patent: Mar. 24, 2020

(54) MANUAL SNOW SHOVEL WITH SNOW COMPRESSION MEANS FOR GRAVITATIONALLY AIDED UNLOADING

(71) Applicant: Gregory S. Andreas, Cranbrook (CA)

(72) Inventor: Gregory S. Andreas, Cranbrook (CA)

( * ) Notice: Subject to any disclaimer, the term of this patent is extended or adjusted under 35 U.S.C. 154(b) by 52 days.

(21) Appl. No.: 15/993,099

(22) Filed: May 30, 2018

(65) Prior Publication Data

US 2019/0368144 A1 Dec. 5, 2019

(51) Int. Cl.
*E01H 5/02* (2006.01)

(52) U.S. Cl.
CPC ..... *E01H 5/02* (2013.01)

(58) Field of Classification Search
CPC ..... E01H 5/02; A01B 1/02; A01B 1/028
USPC .... 294/54.5, 177, 59; 37/265, 270, 284, 285
See application file for complete search history.

(56) References Cited

U.S. PATENT DOCUMENTS 801,090 A 10/1905 Kenney
845,549 A 2/1907 Henry
1,016,998 A 2/1912 Johanning et al.
1,101,149 A 6/1914 Schoener
1,426,442 A * 8/1922 Ferdinand ..... A01B 1/22 294/49
1,743,161 A 1/1930 Prindle
2,190,558 A * 2/1940 Cote ..... E01H 5/02 37/265
2,284,075 A 5/1942 Tucker
2,357,114 A * 8/1944 Howe ..... F24B 15/06 294/177
2,734,291 A 2/1956 Lasker
2,852,872 A 9/1958 Benz
2,933,836 A 4/1960 McKinley
3,017,710 A * 1/1962 Carlson ..... B60B 37/10 37/434
3,063,174 A 11/1962 Ludin
3,082,554 A 3/1963 Steeb
3,248,811 A 5/1966 Pravednekow
3,747,311 A 7/1973 DeCoene et al.
(Continued)

FOREIGN PATENT DOCUMENTS

CA 2376041 9/2003
DE 8501609.8 7/1985
(Continued)

*Primary Examiner* — Dean J Kramer
(74) *Attorney, Agent, or Firm* — Kyle R Satterthwaite; Ryan W Dupuis; Ade & Company Inc.

(57) ABSTRACT

A snow shovel features a support sled, an inclined load blade having an upwardly and rearwardly tapered shape; and up-turned and in-turned side walls that converge in the tapering direction of the load blade. An up-turned and front-turned rear wall cooperates with the side walls to form a forwardly open pocket at a rear end of the blade. The converging side walls and rear pocket compress the snow as it rides up the load blade, whereupon an increased density of the tightly packed snow encourages gravitationally unloading of the shovel through an avalanching action. In use, the leading edge of the shovel is tilted upward as one approaches an intended dumping area in order to ride up onto remaining fallen snow, during which the collected and densely compacted snow avalanches off the leading edge of the shovel to simultaneously build and climb up a snow heap at the dump area.

17 Claims, 6 Drawing Sheets

(56) References Cited

U.S. PATENT DOCUMENTS

| | | | | |
|---|---|---|---|---|
| D296,406 | S | 6/1988 | Fuller | |
| 4,865,372 | A * | 9/1989 | Gabriel | A01B 1/00 294/49 |
| 5,271,169 | A | 12/1993 | Konsztowicz | |
| 5,476,299 | A * | 12/1995 | Whaley | A01B 1/02 294/177 |
| 5,906,060 | A | 5/1999 | Tonry | |
| 5,975,602 | A * | 11/1999 | Zan | E01H 5/02 294/54.5 |
| 7,401,826 | B1 | 7/2008 | Marrett | |
| 7,762,597 | B2 | 7/2010 | Marlin | |
| D626,388 | S | 11/2010 | Greenly et al. | |
| 8,631,593 | B1 | 1/2014 | Ferris | |
| 2004/0178646 | A1 | 9/2004 | Root et al. | |
| 2005/0160632 | A1* | 7/2005 | Williams | B62B 1/147 37/265 |
| 2012/0047777 | A1 | 3/2012 | Andreas | |
| 2014/0091587 | A1* | 4/2014 | Martin | A01B 1/02 294/176 |
| 2016/0024733 | A1 | 1/2016 | Hanks | |

FOREIGN PATENT DOCUMENTS

| | | |
|---|---|---|
| DE | 29806514 | 9/1998 |
| FR | 2951748 | 10/2009 |

* cited by examiner 10
32
34
28
24
14
22
12
20
5ci
5ca
5F
B
G
AD
AA
AC 10
32
14
22
12
24
20
5ci
5ca
5F
B
G
AD
AA
AC

MANUAL SNOW SHOVEL WITH SNOW COMPRESSION MEANS FOR GRAVITATIONALLY AIDED UNLOADING

FIELD OF THE INVENTION

The present invention relates generally to snow shovels, and more particularly to snow shovels of a type employing a support sled on which an inclined load blade is supported to push and carry a snow load to an intended dump area.

BACKGROUND

Applicant previously proposed a snow shovel of the forgoing general type in Canadian Patent No. 2,712,534 and Published U.S. Patent Application 2012/0047777, the entireties of which are incorporated herein by reference, but has since developed a new and improved design offering additional functional benefits over both Applicant's prior design and other known prior art.

SUMMARY OF THE INVENTION

According to a first aspect of the invention, there is provided a manual snow shovel comprising:

a support sled comprising a base for sliding movement over a ground surface from which snow is to be cleared;

a snow working unit carried atop said support sled for movement therewith over the ground surface;

a handle support structure coupled to the support sled and extending upwardly and rearwardly therefrom; and a handle carried on the handle support structure at a location spaced upwardly and rearwardly from the support sled and the blade for manual gripping of the handle by an operator in order to displace said support sled over the ground surface;

wherein said snow working unit comprises:

an inclined load blade carried atop the support sled in a position angling upwardly and rearwardly from a lower front edge of said inclined load blade toward an opposing upper rear end thereof, said inclined load blade having a tapered shape that narrows away from said front lower edge toward the upper rear end of said inclined load blade so that opposing sides of said inclined load blade rearwardly converge with one another toward said upper rear end of said inclined load blade; and up-turned and in-turned side walls connected to the inclined load blade at opposing sides thereof and reaching upwardly and inwardly from said opposing sides of said inclined load blade.

According to a second aspect of the invention, there is provided a method of clearing snow from a ground surface using the above-recited manual snow shovel, said method comprising:

using the manual handle, pushing the manual snow shovel forwardly to drive the lower front edge of the inclined load blade forwardly through or under a layer of snow cover, thereby lifting collected snow from said layer onto the inclined load blade and upwardly and rearwardly therealong; and as said collected snow rises upwardly and rearwardly along said inclined load blade, using the up-turned and in-turned side walls to pack said collected snow into a more compressed state.

According to a third aspect of the invention, there is provided a manual snow shovel comprising:

a support sled comprising a base for sliding movement over a ground surface from which snow is to be cleared;

a snow working unit carried atop said support sled for movement therewith over the ground surface;

a handle support structure coupled to the support sled and extending upwardly and rearwardly therefrom; and a handle carried on the handle support structure at a location spaced upwardly and rearwardly from the support sled and the blade for manual gripping of the handle by an operator in order to displace said support sled over the ground surface;

wherein said snow working unit comprises:

an inclined load blade carried atop the support sled in a position angling upwardly and rearwardly from a lower front edge of said inclined load blade toward an opposing upper rear end thereof; and a forwardly-opening pocket defined at the upper rear end of the inclined load blade; and side walls running along opposing sides of the inclined load plate from opposite sides of the forwardly-opening pocket toward the lower front end of the inclined load blade in order to guide accumulated snow on the inclined load blade into said forwardly-opening pocket.

According to a fourth aspect of the invention, there is provided a method of clearing snow from a ground surface using the above-recited manual snow shovel, said method comprising:

using the manual handle, pushing the manual snow shovel forwardly to drive the lower front edge of the inclined load blade forwardly through or under a layer of snow cover, thereby lifting collected snow from said layer onto the inclined load blade and upwardly and rearwardly therealong; and as said snow rises upwardly and rearwardly along said inclined load blade, using the forwardly-opening pocket and the side walls to pack said collected snow into a more compressed state.

According to a fifth aspect of the invention, there is provided a method of clearing snow from a ground surface using a manual snow shovel having a support sled with a base for sliding movement over a ground surface from which snow is to be cleared, a handle support structure coupled to the support sled and extending upwardly and rearwardly therefrom, a handle carried on the handle support structure, an inclined load blade carried atop the support sled in a position angling upwardly and rearwardly from a lower front edge of said inclined load blade toward an opposing upper rear end thereof, and confining walls distributed around said inclined load blade, said method comprising:

using the manual handle, pushing the manual snow shovel forwardly to drive the lower front edge of the inclined load blade forwardly through or under a layer of snow cover, thereby lifting collected snow from said layer onto the inclined load blade and upwardly and rearwardly therealong; and as said snow rises upwardly and rearwardly along said inclined load blade, constraining at least some of the snow between the confining walls, and thereby packing said collected snow into a more compressed state.

BRIEF DESCRIPTION OF THE DRAWINGS

One embodiment of the invention will now be described in conjunction with the accompanying drawings in which.

DETAILED DESCRIPTION

Figure 1:
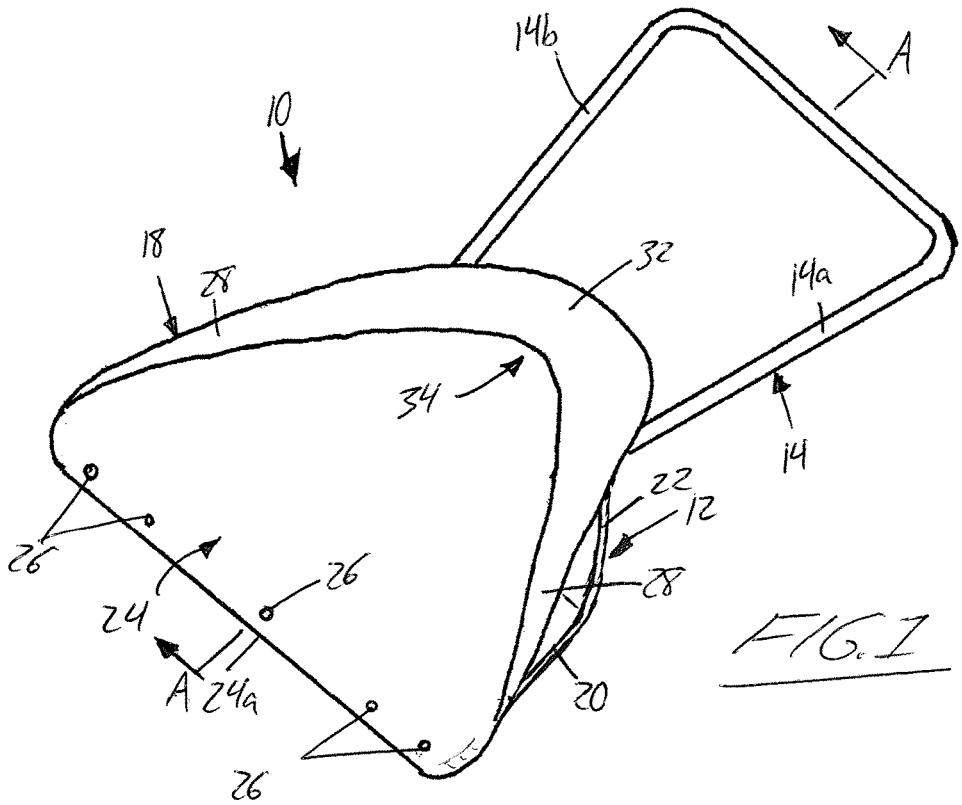
FIG. 1 is a front perspective view of a manual snow shovel of the present invention featuring a snow working unit mounted atop a handle-equipped support sled.

FIG. 1 illustrates a manual snow shovel 10 according to the present invention. The shovel features a support sled 12, a handle support structure 14 coupled thereto, a manual handle 16 carried by the handle support structure 14, and a snow working unit 18 mounted atop the support sled 12 for movement therewith under manipulation with the handle to convey the support sled 12 over the ground in a sliding manner.

The support sled 12 features a flat, or substantially flat, horizontally oriented base panel 20 having a front leading edge 20*a* and an opposing rear trailing edge 20*b* from which a rear wall 22 of the support sled curves upwardly with a forwardly concave curvature. The flat or substantially flat underside of the base panel 20 forms one or more planar surfaces that provide a sliding interface for displacement of the sled over snow or ground, and a surface area spanning a full or substantial width of the snow working unit mounted atop the sled. The base panel 20 bears the weight of the device and any snow loaded onto the snow working unit.

The handle support structure 14 features two rails 14*a*, 14*b* of metal tubing or other suitably rigid configuration sloping linearly upward and rearward from the support sled 12, for example from respective mounting brackets (not shown) attached to the back of the support sled's rear wall. The handle 16 is in the form of a bar, rail, tube or other cross member extending laterally across the two handle support rails 14*a*, 14*b* at their upper rear ends furthest from the support sled at an elevated location rearwardly therefrom to present a suitable gripping area between the support rails 14*a*, 14*b* for grasping by the hands of an operator in order to maneuver the shovel 10. The support sled in the illustrated embodiments resembles the scoop of a conventional scoop-style snow shovel, though as illustrated in FIG. 1, with the side walls of the scoop optionally omitted.

The snow working unit features an inclined load blade 24 having a lower front leading edge 24 that resides in the same plane occupied by the flat base panel 20 of the support sled 12, and that overlies or slightly leads the front leading edge 20*a* of the support sled's base panel 20. At or closely adjacent these leading edges, the load blade 24 is attached to the base panel 20 of the support sled 12, for example by fasteners 26. The blade 24 slopes upward and rearward from its leading edge 24*a* toward an upper rear end 24*b* of the blade situated opposite the leading edge 24*a*. Opposing sides of the blade 24 extend rearwardly from opposite ends of the leading edge 24*a* thereof and converge toward one another in their travel toward the opposing rear end 24*b* of the blade. The blade 24 therefore has a tapered shape of generally triangular or wedge-shaped configuration that narrows away from the leading edge 24*a* toward the rear end 24*b* of the blade.

In addition to the loading blade 24, the snow working unit 18 features a pair of side walls 28 each spanning a substantial majority of a respective side of the loading blade 24 from near the leading edge 24*a* of the blade 24 all the way to the rear end 24*b* of the blade 24. Each side wall 28 initially curves upwardly and outwardly from a seamlessly integral connection with the respective side of the loading blade 24, but also has areas where the side wall 28 continues curving in the same direction so as to turn back over itself to reach inwardly over the loading blade toward a vertical mid-plane of the shovel across which the handle, support sled and snow working unit are each symmetrical.

Figure 2:
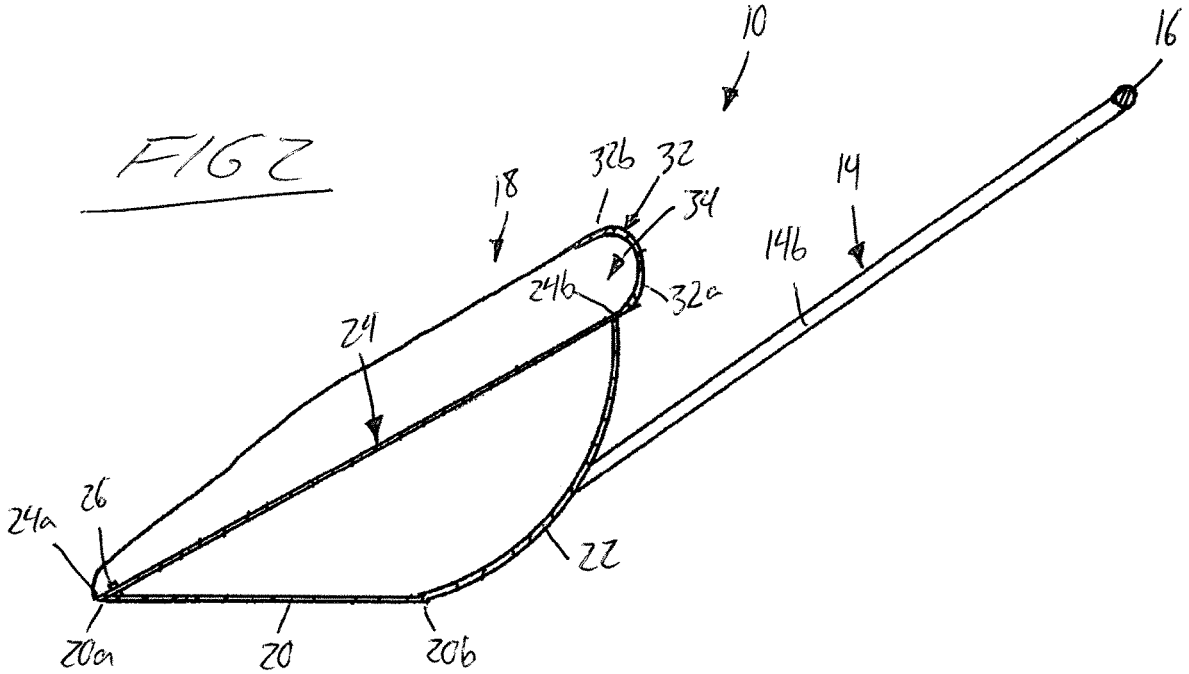
FIG. 2 is a cross-sectional view of the manual snow shovel of FIG. 1 as taken along line A-A thereof.
Figure 3:
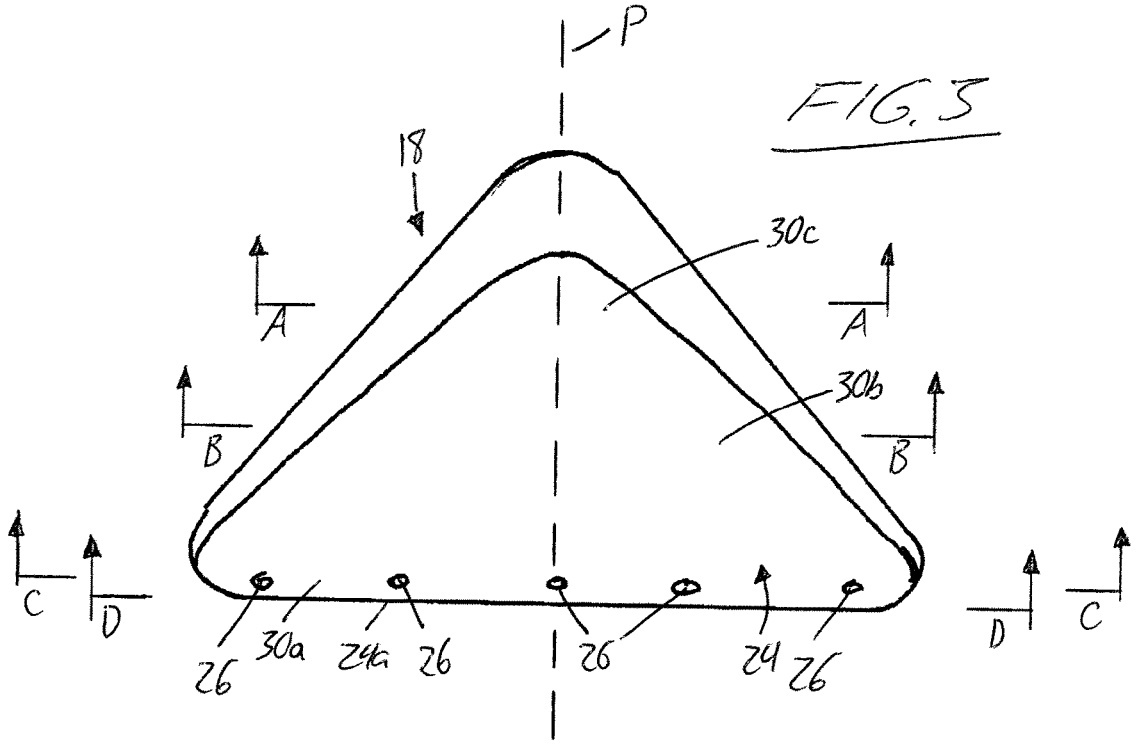
FIG. 3 is an overhead plan view of the snow working unit of the manual snow shovel of FIG. 1.
Figure 3A:
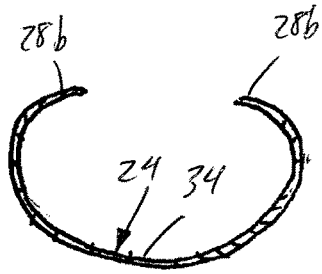
FIG. 3A is a cross-sectional profile of the snow working unit of FIG. 3 as viewed along line A-A thereof.
Figure 3B:
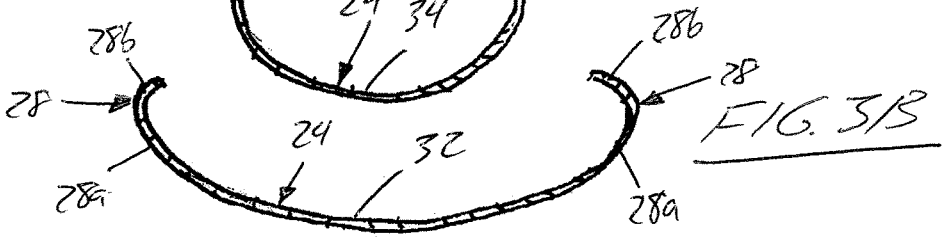
FIG. 3B is a cross-sectional profile of the snow working unit of FIG. 3 as viewed along line B-B thereof.
Figure 3C:
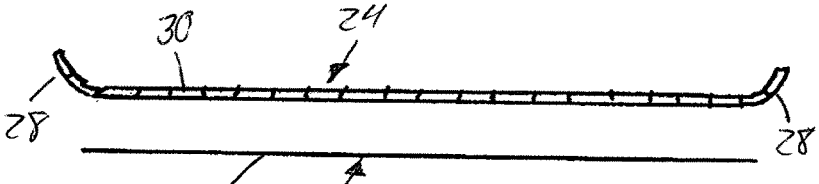
FIG. 3C is a cross-sectional profile of the snow working unit of FIG. 3 as viewed along line C-C thereof.
Figure 3D:
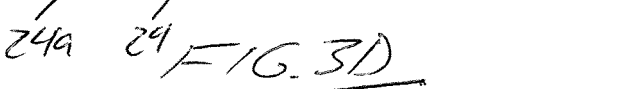
FIG. 3D is a cross-sectional profile of the snow working unit of FIG. 3 as viewed along line D-D thereof.

FIG. 2 illustrates a cross-section of the shovel taken in this vertical mid-plane P, while FIGS. 3A-3D illustrate the working unit 18 of the shovel in vertical cross-sectional planes lying perpendicular to the mid-plane P. As illustrated in FIGS. 3A-3D, the load blade 24 has a non-uniform profile that varies among these different cross-sectional planes. At the leading edge 24*a*, the blade 24 is entirely planar throughout the width dimension of the blade, which is measured perpendicularly of the mid-plane plane from one side of the blade to the other. The leading edge 24*a* is thus of straight linear form as illustrated in the cross-sectional view of FIG. 3D. In a lower area 30*a* of the blade 24 immediately adjacent the leading edge 24*a*, the blade is also planar over the full width dimension, as shown in FIG. 3C. FIG. 3C also illustrates that the side walls 28 begin to emerge from the blade 24 at this lower area 30*a*. Each side wall 28 initially curves only upwardly and outwardly from the blade 24. The inner surface of the side wall facing toward the opposite side wall has a smooth concave curvature that seamlessly joins with the flat topside of the planar lower area 30 of the blade 24 without any corner edge or discontinuity.

FIG. 3B shows a cross-sectional profile of the blade at an intermediate area 30*b* further upward thereon, where the topside of the blade 24 is now of concave curvature rather than planar form and the side walls curve further and more aggressively. Here, the side walls 28 curve initially upward and outward, but then turn inwardly back over themselves to reach inwardly over a fraction of the blade's width 24. Each side wall 28 is thus marked as having distinctly directed portions, namely an originating portion 28*a* of upward and outward curvature, and a terminating portion 28*b* of inward curvature. Finally, FIG. 3A shows a cross-sectional profile of the blade 24 at an upper area 30*c* even further upward thereon, where the topside of the blade 24 is of more aggressive concave curvature, and the side walls curve even further and more aggressively at originating and terminating portions 28*a*, 28*b*. At all side-walled areas 30*a*, 30*b*, 30*c* of the blade, the joining of the side walls with the blade is with a smooth and continuous concave curvature so that the topside of the blade and the inner surfaces of the side walls facing inwardly over the blade toward the mid-plane are free of any hard edges or discontinuities.

At the rear end 24*b* of the blade 24, a rear wall 32, in a manner similar to the side walls 28 at the sides of the blade 24, curves initially upward and outward from the rear end 24*b* of the blade and continues to follow this concave curvature so as to turn back over itself and reach inwardly over the blade. This curved rear wall thus turns initially upwardly and rearwardly, and then forwardly, from the rear end of the blade 24 in a smooth, continuous fashion free of any corners or discontinuities. The rear wall 32 thus has an originating portion 32*a* of upward and rearwardly outward curvature, and a terminating portion 32*b* of forwardly-reaching curvature. Not only is this rear wall 32 seamlessly integral with the blade 24, but it also joins seamlessly and integrally with both the side walls 28. The curved rear wall 32 thus forms a forwardly open pocket 34 that is closed at the top by the terminating portion 32*b* of the rear wall 32, closed at the rear by the originating portion 32*a* of the rear wall, and closed on both sides by the connected side walls 28 that reach forwardly from this pocket at opposite sides thereof toward the lower front leading edge 24*a* of the blade 24.

The distance by which the terminal portion 28*b* of each side wall 28 reaches inwardly over the blade 24 increases moving rearwardly along the side wall from its emerging front end near the blade's leading edge 24*a* toward the forward-opening pocket 34 at the rear end 28*b* of the blade 24. Except at the pocket 34, the topside of the snow working unit 18 is open, leaving a majority of the blade's topside uncovered by the in-turned side walls and front-turned rear wall. Viewed in plan, the smaller covered area of the blade's topside has a boomerang shape following the rearwardly converging sides of the blade and spanning across the pocketed rear end of the blade, leaving a generally triangular opening over the majority of the blade's area. The topside of the blade itself is a smooth, continuous uninterrupted surface free of any edges or discontinuities in both the width dimension between the side walls, and the front/rear longitudinal direction between the leading edge and the opposing rear end.

A prototype of the present invention was produced by cutting a sheet of semi-rigid plastic into a suitably shaped blank of tapered front-to-rear shape. Edge-adjacent portions of the sheet were then rolled inwardly over a topside of the sheet and then riveted together to form the seamlessly integral side and rear walls with concave inner sides facing inwardly over a central blade area defined by the remaining majority area of the sheet. A scoop style snow shovel was used as the support sled. The unrolled front edge of the plastic sheet was fastened to the leading edge of the snow scoop to hold this front edge of the otherwise curved plastic sheet flat, thereby forming the linear leading edge 24*a* and adjacent planar area 30*a* of the blade 24.

In order to enable such rolled edges of the sheet to form both the side walls and the rear wall, corners areas of the sheet were notched out at the narrower end of the sheet to enable rolled folding of these edges in the different directions necessary to form the different walls. These notched out corners left two small openings in the rear wall of the pocket 34 on opposite sides of the mid-plane. It is envisioned that a metal blank could likewise be roll-formed into the described shape of the snow working unit, but production of the unit need not be limited to such rolled sheet production techniques. For example, the described shape may alternatively be achieved with plastic molding or composite forming techniques.

Figure 4:
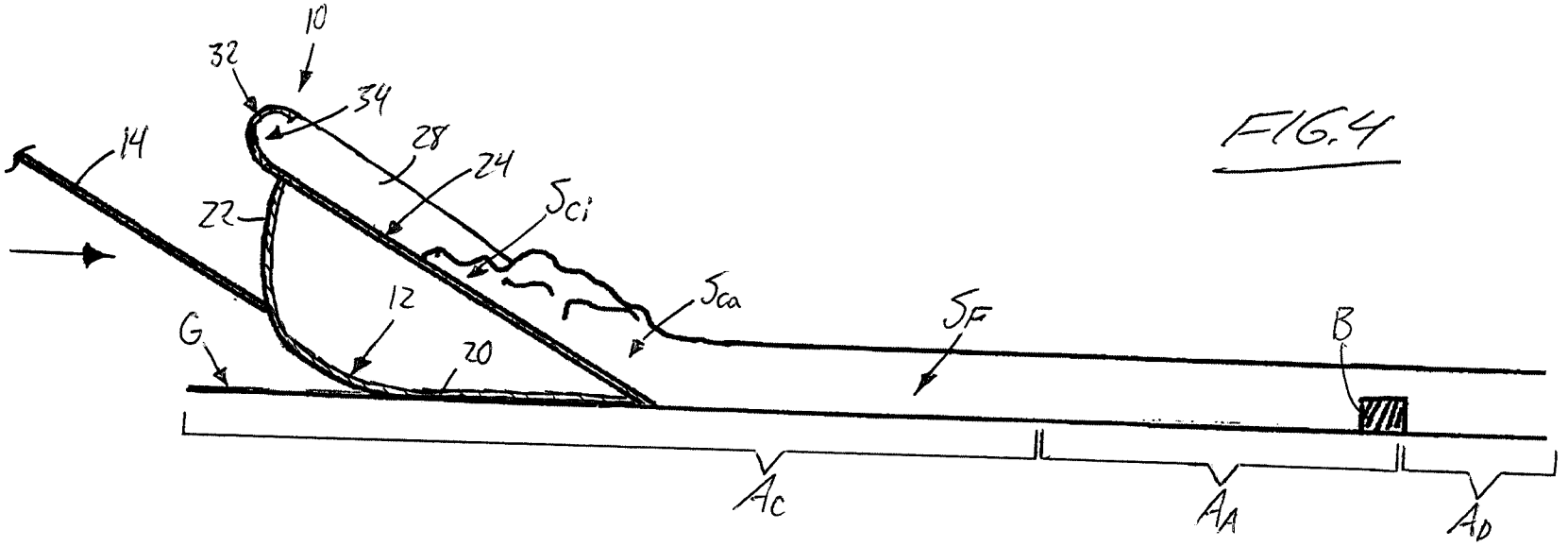
FIG. 4 is an elevational side view illustrating a first stage of a snow clearing pass using the cross-sectioned manual snow shovel of FIG. 2.

Having described the structure of the apparatus, attention is now turned to its method of use, as illustrated in FIGS. 4 through 8. FIG. 4 shows a ground surface G on which a layer of fallen snow $S_F$ has built up. The ground surface is divided into a clearing area $A_C$ from which the fallen snow S is to be cleared, a nearby dumping area $A_D$ at which the cleared snow is to be deposited, and an approach area $A_A$ that transitions from the clearing area to the dumping area. In the figures, a discernable boundary B between the approach and dumping areas is shown as an upward protrusion from the ground surface, and may for example be in the form of a concrete curb, stone edging, etc. However, it will be appreciated that the discernable boundary, if present, may take any variety of forms, while in other instances, there may be not be a discernable boundary between the approach area and dumping area.

Still referring to FIG. 4, the operator uses the manual handle 16 to push the manual snow shovel 10 forwardly to slide the base panel 20 of the support sled 12 along the ground surface G over the clearing area $A_C$ toward the dumping area $A_D$. This horizontal sliding of the shovel 10 drives the leading edge 24*a* of the inclined load blade 24 forwardly through or under the layer of fallen snow $S_F$, thereby lifting an initial collection of snow $S_{Ci}$ from this layer onto the inclined load blade 24 and displacing this snow $S_{Ci}$ upwardly along the load blade 24 toward the pocket 34 at the rear end thereof. As this initially collected snow $S_{Ci}$ rises upwardly over the inclined load blade 24, the side walls 28 not only block the collected snow from falling laterally off the load blade, but due their rearward convergence, also cause the collected snow to be laterally compacted in the width direction of the load blade as it moves upwardly and rearwardly therealong. Laterally outermost portions of the collected snow that are riding up the load blade 24 at the covered areas thereof underlying the in-turned terminal portions 28*b* of the side walls 28 are captured in this covered space between the load blade 24 and the in-turned terminal portions 28*b* of the side walls.

Figure 5:
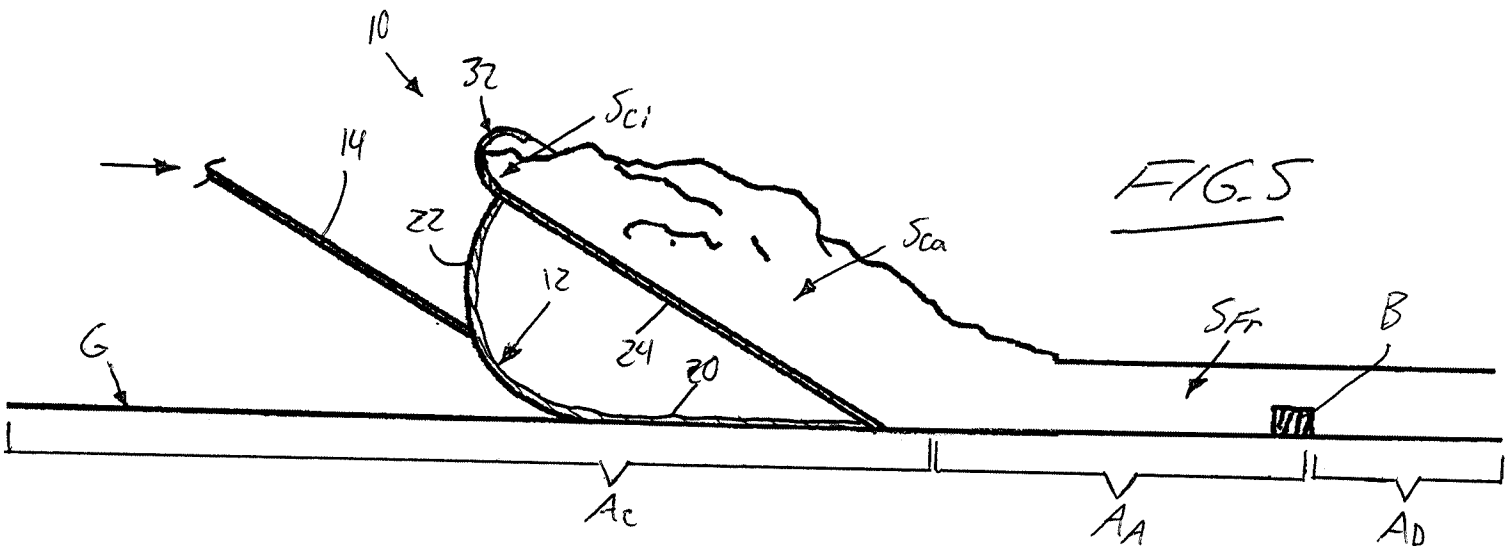
FIG. 5 is an elevational side view illustrating a second stage of the snow clearing pass.

Turning to FIG. 5, continued forward displacement of the shovel 10 over the collection area $A_C$ lifts more snow onto the load blade, which pushes the initially collected snow $S_{Ci}$ further upwardly on the load blade into the rear pocket 34. Here, the up-turned originating portion 32*a* of the rear wall 32 blocks the initially collected snow $S_{Ci}$ from falling off the rear end 24*b* of the load blade 24, while the front-turned terminal portion 32*b* of the rear wall 32 contains an uppermost portion of the initially collected snow $S_{Ci}$ in the covered space between the load blade 24 and this front-turned terminal portion 32*b* of the rear wall 32. Since rear wall 32 prevents the initially collected snow $S_{Ci}$ from falling off the rear end 24*b* of the inclined load blade, and its front-turned terminal portion 32*b* at the top end of the pocket 34 prevents the initially collected snow $S_{Ci}$ from being able to spill over the rear wall itself 32, additionally collected snow $S_{Ca}$ rising onto the load blade 24 during continued forward displacement of the shovel pushes upwardly and rearwardly against the initially collected snow $S_{Ci}$. This action packs the initially collected snow $S_{Ci}$ more tightly rearward into the pocket 34 and more tightly outward into the sidewall-covered spaces at the sides of the load blade. The initially collected snow $S_{Ci}$ accumulated on the load blade is thus compressed longitudinally rearward against the rear wall 34 of the pocket, and laterally outward against the side walls 28. During this packing of the initially collected snow $S_{Ci}$ more tightly into the covered spaces under the in-turned and front-turned side and rear walls 28, 32, this initially collected snow $S_{Ci}$ fills up against the in-turned and front-turned portions 28*b*, 32*b* of the side and rear walls 28, 32, thus also compressing this confined snow upwardly. The shovel thus compresses the initially collected snow SDI in three dimensions, resulting notably increased snow density atop the load blade. Continued forward pushing of the shovel drives this densely compressed snow $S_{Ci}$ on the load blade forwardly against remaining fallen snow $S_{Fr}$ in front of the shovel, which may act to compress this remaining fallen snow $S_{Fr}$ in the travel direction of the shovel.

Figure 6:
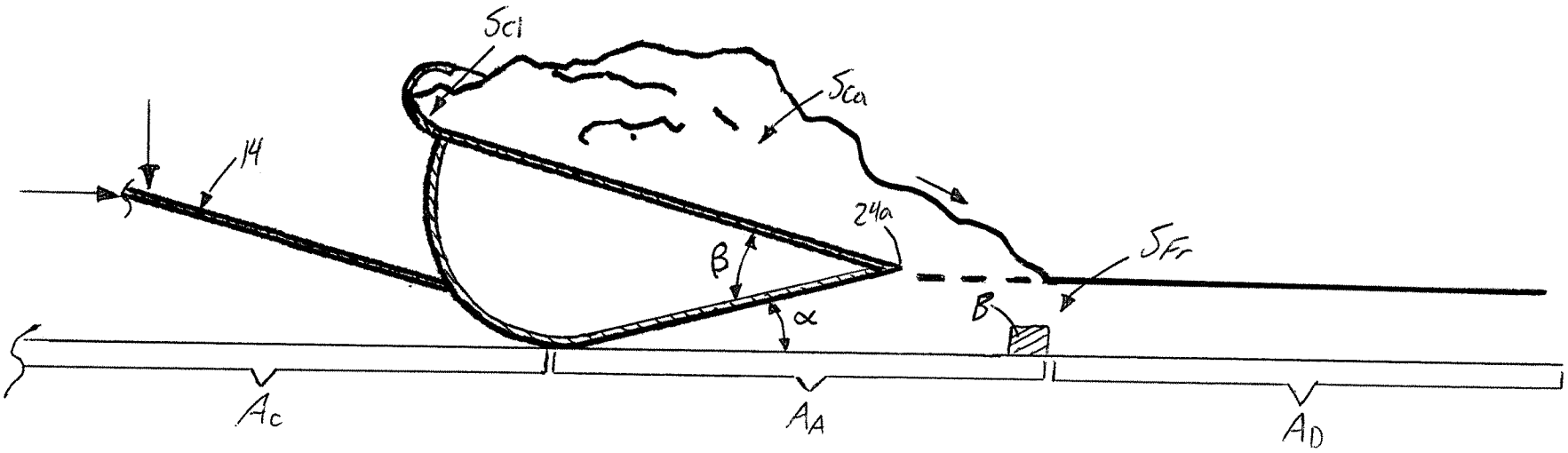
FIG. 6 is an elevational side view illustrating a third stage of the snow clearing pass.

Turning to FIG. 6, as the shovel is pushed further forward into the approach area $A_A$, the operator tilts the handle downwardly, thus tilting the base 20 of the support sled 12 upwardly to lift the leading edge 24*a* of the load blade 24 off the ground surface G. The operator continues to push the handle forwardly, whereby the tilted support sled and load blade ride up over the remaining fallen snow $S_{Fr}$ that still blankets the approach and dumping areas $A_A$,$A_D$. The angle $\alpha$ by which the support sled is tilted upward is less than the angle between the load blade 24 and the base panel 20 of the support sled, whereby the load blade 24 still has a slight level of incline from its leading edge to its pocket-equipped rear end. This way, the leading edge 24A of the load blade 24 is at lesser elevation than the pocket equipped rear end of the load blade 24. As shown in FIG. 6, if the leading edge 24*a* of the load blade 24 is lifted sufficiently high, then the remaining fallen snow $S_{Fr}$ no longer obstructs the collected snow $S_{Ci}$,$S_{Ca}$ from sliding off the leading edge of the load blade, and so even with a relatively small angle of load blade inclination in this tilted state of the shovel, the increased density of the collected snow due to the compression thereof in the forwardly-opening pocket and the sidewall covered areas of the load blade causes the collected snow $S_{Ci}$,$S_{Ca}$ to avalanche down the load blade 24 and thus spill forwardly over the leading edge 24*a* thereof onto the remaining fallen snow $S_{Fr}$.

Figure 7:
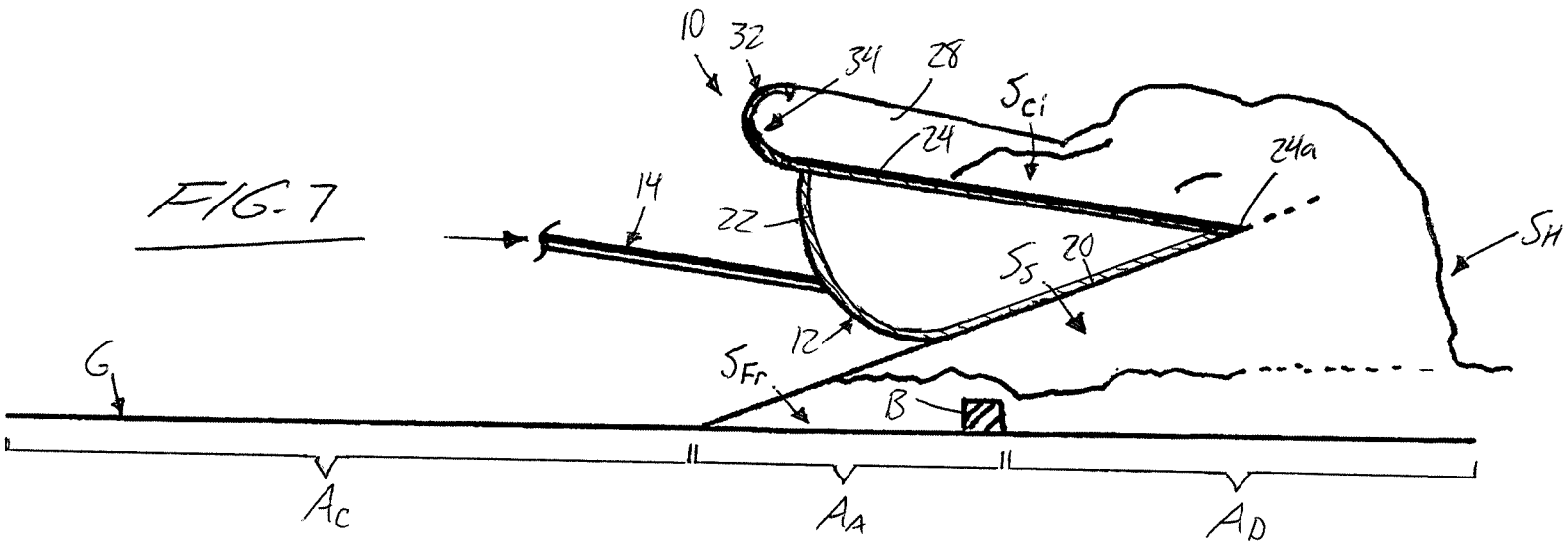
FIG. 7 is an elevational side view illustrating a fourth stage of the snow clearing pass.
Figure 8:
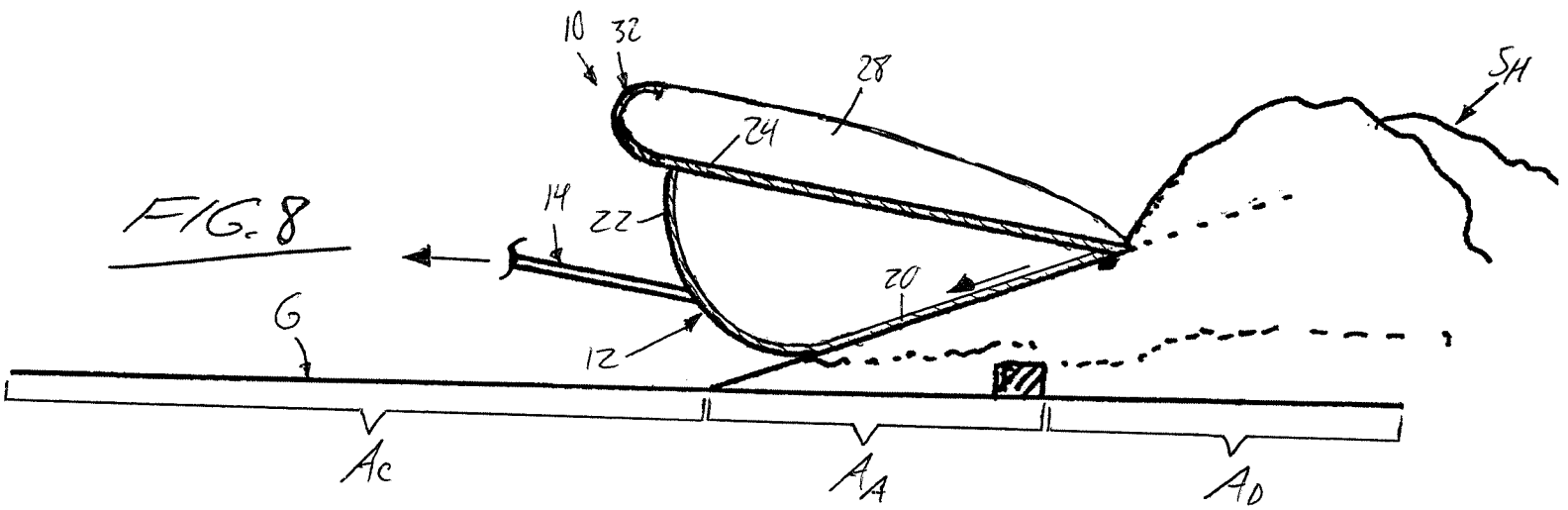
FIG. 8 is an elevational side view illustrating a fifth stage of the snow clearing pass.
Figure 9:
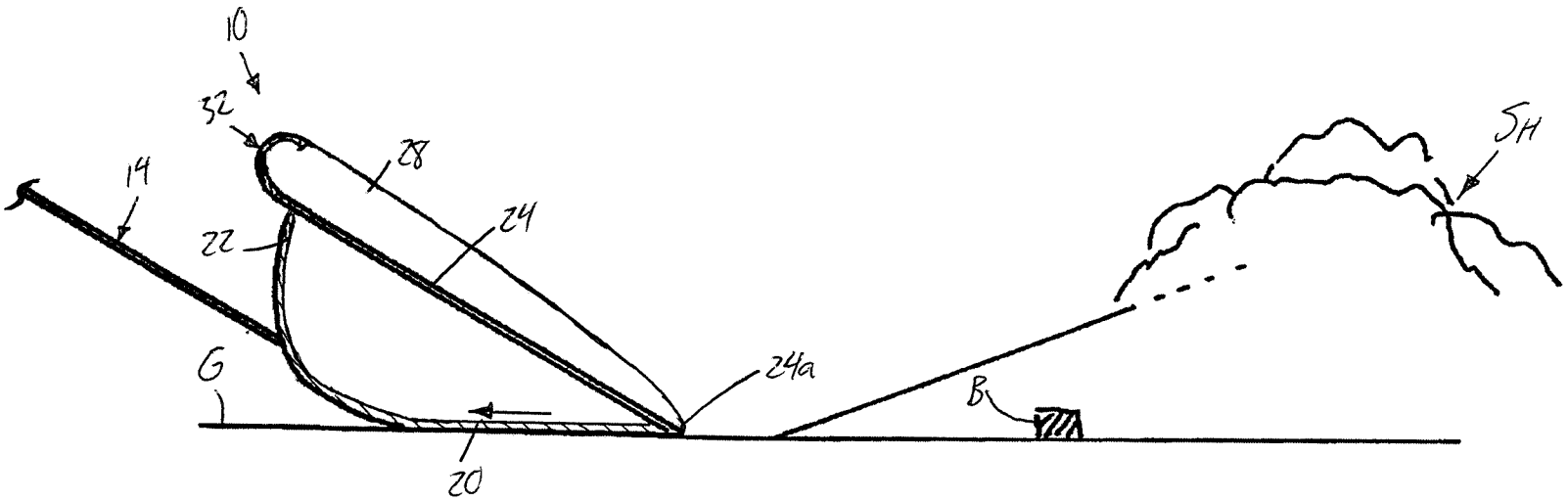
FIG. 9 is an elevational side view illustrating the cross-sectioned manual snow shovel after completion of the snow clearing pass.

Turning to FIG. 7, the operator continues to push forwardly on the handle 16, whereby the shovel 10 rides upwardly over a snow heap $S_H$ formed by the combination of the remaining fallen snow $S_{Fr}$ and the spilled $S_S$ snow that has gravitationally spilled off the leading edge of the load blade 24 onto the remaining fallen snow $S_{Fr}$. Once the shovel 10 has ridden sufficiently far up the snow heap $S_H$ to dump all the collected snow $S_{Ci}$,$S_{Ca}$ off the leading edge 24*a* of the load blade 24 under the gravitational avalanching action of the densified snow compressed by the side walls and pocket of the shovel 10, then the shovel 10 is either pulled or allowed to gravitationally ride rearwardly down the snow heap $S_H$ back to the clearing area, as shown in FIGS. 8 and 9. This marks completion of one pass of a snow clearing operation on said clearing area. This same process is then repeated for as many passes as are necessary to fully clear the clearing area of the fallen snow.

In summary, the up-turned and in-turned side walls of converging relation and the up-turned and front-turned rear wall collectively define a set of cooperating confinement walls that impart density-increasing compression on the snow being collected onto the load blade, whereby later unloading of the collected snow, the densely packed snow encourages gravitational unloading of the blade through an avalanching action to enable unloading of the blade at lesser angles of incline, thereby reducing or omitting the need to tilt the blade downward by lifting the handle, as is typically required to unload conventional scoop-type snow shovels.

It will be appreciated that regardless of whether the particular clearing procedure described above is followed or not, the design of the shovel with its converging up-turned and in-turned side walls and its forwardly-opening rear pocket 34 provides a novel shovel with a unique snow-compressing action that increases the density of the snow collected atop the load blade. This action combines with the notably inclined angle of the load blade to gravitationally dump the collected snow in an avalanching fashion, wherein the weight of the densely packed snow drives the collected snow downwardly off the leading edge of the load blade. Accordingly, unloading of snow from the shovel is easier than with conventional scoop shovels, where the snow-loaded floor of the scoop lies generally flat on the ground, and dumping requires lifting of the handle in order to tilt the floor the scoop forwardly downward to cause the collected snow to spill over the scoops leading edge.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A manual snow shovel comprising:

a support sled comprising a base for sliding movement over a ground surface from which snow is to be cleared;

a snow working unit carried atop said support sled for movement therewith over the ground surface;

a handle support structure coupled to the support sled and extending upwardly and rearwardly therefrom; and a handle carried on the handle support structure at a location spaced upwardly and rearwardly from the support sled for manual gripping of the handle by an operator in order to displace said support sled over the ground surface;

wherein said snow working unit comprises:

an inclined load blade carried atop the support sled in a position angling upwardly and rearwardly from a lower front edge of said inclined load blade toward an opposing upper rear end thereof, said inclined load blade having a tapered shape that narrows away from said front lower edge toward the upper rear end of said inclined load blade so that opposing sides of said inclined load blade rearwardly converge with one another toward said upper rear end of said inclined load blade; and up-turned and in-turned side walls connected to the inclined load blade at opposing sides thereof and reaching upwardly and inwardly from said opposing sides of said inclined load blade; and wherein:

at elevated areas of the inclined load blade spaced upwardly and rearwardly from the lower front edge thereof, a topside of said inclined load blade is of concave curvature in a width direction in which said opposing sides of the inclined load blade are spaced from one another; and the concave curvature of the topside of said inclined load blade at said elevated areas is of increasingly aggressive concavity toward the upper rear end of said inclined load blade.

2. The manual snow shovel of claim 1 wherein the inclined load blade, at a lower area thereof adjacent the lower front edge, is planar in the width direction over at least a majority of said lower front edge.

3. A manual snow shovel comprising:

a support sled comprising a base for sliding movement over a ground surface from which snow is to be cleared;

a snow working unit carried atop said support sled for movement therewith over the ground surface;

a handle support structure coupled to the support sled and extending upwardly and rearwardly therefrom; and a handle carried on the handle support structure at a location spaced upwardly and rearwardly from the support sled for manual gripping of the handle by an operator in order to displace said support sled over the ground surface;

wherein said snow working unit comprises:

an inclined load blade carried atop the support sled in a position angling upwardly and rearwardly from a lower front edge of said inclined load blade toward an opposing upper rear end thereof, said inclined load blade having a tapered shape that narrows away from said front lower edge toward the upper rear end of said inclined load blade so that opposing sides of said inclined load blade rearwardly converge with one another toward said upper rear end of said inclined load blade; and up-turned and in-turned side walls connected to the inclined load blade at opposing sides thereof and reaching upwardly and inwardly from said opposing sides of said inclined load blade; and wherein the up-turned and in-turned side walls are of concave curvature at inner sides thereof that face inwardly over the inclined load blade.

4. The manual snow shovel of claim 3 wherein the snow working unit comprises an up-turned and front-turned rear wall situated at the upper rear end of said inclined load surface.

5. The manual snow shovel of claim 4 wherein the inclined load blade, the up-turned and in-turned side walls and the up-turned and front-turned rear wall are seamlessly integral with one another.

6. The manual snow shovel of claim 5 wherein the up-turned and front-turned rear wall is of concave curvature at an inner side thereof that faces inwardly over the inclined load blade.

7. The manual snow shovel of claim 4 wherein said up-turned and in-turned side walls join with the up-turned and front-turned rear wall proximate the upper rear end of the inclined load blade and thereby form a forwardly open pocket at said upper rear end of the inclined load blade.

8. The manual snow shovel of claim 4 wherein the up-turned and front-turned rear wall is of concave curvature at an inner side thereof that faces inwardly over the inclined load blade.

9. The manual snow shovel of claim 3 wherein, at elevated areas of the inclined load blade spaced upwardly and rearwardly from the lower front edge thereof, a topside of said inclined load blade is of concave curvature in a width direction in which said opposing sides of the inclined load blade are spaced from one another.

10. The manual snow shovel of claim 9 wherein the concave curvature of the topside of said inclined load blade at said elevated areas is of increasingly aggressive concavity toward the upper rear end of said inclined load blade.

11. The manual snow shovel of claim 3 wherein the inclined load blade and the up-turned and in-turned side walls are seamlessly integral with one another.

12. The manual snow shovel of claim 3 wherein a distance by which each up-turned and in-turned side wall reaches inwardly over the inclined load blade increases in an upwardly and rearward direction toward the upper rear end of the inclined load blade.

13. The manual snow shovel of claim 12 wherein the inclined load blade has a blade length dimension measured from said lower front edge to said upper rear end, and is left uncovered between the up-turned and in-turned side walls over at least part of said blade length dimension.

14. The manual snow shovel of claim 13 wherein said inclined load blade is left uncovered between the up-turned and in-turned side walls over a majority of said blade length dimension.

15. A manual snow shovel comprising:

a support sled comprising a base for sliding movement over a ground surface from which snow is to be cleared;

a snow working unit carried atop said support sled for movement therewith over the ground surface;

a handle support structure coupled to the support sled and extending upwardly and rearwardly therefrom; and a handle carried on the handle support structure at a location spaced upwardly and rearwardly from the support sled for manual gripping of the handle by an operator in order to displace said support sled over the ground surface;

wherein said snow working unit comprises:

an inclined load blade carried atop the support sled in a position angling upwardly and rearwardly from a lower front edge of said inclined load blade toward an opposing upper rear end thereof, said inclined load blade having a tapered shape that narrows away from said front lower edge toward the upper rear end of said inclined load blade so that opposing sides of said inclined load blade rearwardly converge with one another toward said upper rear end of said inclined load blade; and up-turned and in-turned side walls connected to the inclined load blade at opposing sides thereof and reaching upwardly and inwardly from said opposing sides of said inclined load blade; and wherein a distance by which each up-turned and in-turned side wall reaches inwardly over the inclined load blade increases in an upwardly and rearward direction toward the upper rear end of the inclined load blade.

16. The manual snow shovel of claim 15 wherein the inclined load blade has a blade length dimension measured from said lower front edge to said upper rear end, and is left uncovered between the up-turned and in-turned side walls over at least part of said blade length dimension.

17. The manual snow shovel of claim 16 wherein said inclined load blade is left uncovered between the up-turned and in-turned side walls over a majority of said blade length dimension.

* * * * *